US007546332B2

(12) United States Patent
Vlassis

(10) Patent No.: US 7,546,332 B2
(45) Date of Patent: Jun. 9, 2009

(54) APPARATUS AND METHODS FOR IMPLEMENTATION OF MATHEMATICAL FUNCTIONS

(75) Inventor: Spyridon Vlassis, Athens-Attiki (GR)

(73) Assignee: Theta Microelectronics, Inc., San Jose, CA (US)

( * ) Notice: Subject to any disclaimer, the term of this patent is extended or adjusted under 35 U.S.C. 154(b) by 759 days.

(21) Appl. No.: 11/269,988

(22) Filed: Nov. 9, 2005

(65) Prior Publication Data

US 2006/0106904 A1 May 18, 2006

Related U.S. Application Data

(60) Provisional application No. 60/625,979, filed on Nov. 9, 2004.

(51) Int. Cl.
*G06G 7/00* (2006.01)

(52) U.S. Cl. ..... 708/801; 327/346; 327/349

(58) Field of Classification Search ..... 327/346, 327/349; 708/230–236, 606, 801
See application file for complete search history.

(56) References Cited

U.S. PATENT DOCUMENTS 3,982,115 A * 9/1976 Traa ..... 708/847
5,008,632 A 4/1991 Sutterlin
5,060,179 A 10/1991 Sharp
5,065,053 A 11/1991 Chan et al.
5,224,064 A 6/1993 Henry et al.
6,055,553 A 4/2000 Kantabutra
6,184,723 B1 2/2001 Frechette et al.
6,215,292 B1 4/2001 Maggi et al.
6,366,939 B1 4/2002 Kantabutra
6,771,111 B2 8/2004 Sheng et al.

* cited by examiner

*Primary Examiner*—Tan V Mai
(74) *Attorney, Agent, or Firm*—Blakely Sokoloff Taylor & Zafman LLP

(57) ABSTRACT

Apparatus and methods for implementation of mathematical functions apparatus providing both speed and accuracy. Disclosed are specific circuits and methods of operation thereof that may be used for the purpose of implementing an exponential function, a squaring function, and a cubic function, using the same basic circuit. By applying a desired weighting function on a current source, an output current provides a value that corresponds exactly to the desired mathematical functions at discrete points, and closely tracks values in between the discrete points. The precision is defined by the selection of a voltage reference for the circuit. Various embodiments are disclosed, as well as embodiments implementing other exemplary functions.

31 Claims, 3 Drawing Sheets

APPARATUS AND METHODS FOR IMPLEMENTATION OF MATHEMATICAL FUNCTIONS

CROSS-REFERENCE TO RELATED APPLICATION

This application claims the benefit of U.S. Provisional Patent Application No. 60/625,979 filed Nov. 9, 2004.

BACKGROUND OF THE INVENTION

1. Field of the Invention

The present invention relates to electronic circuits for generating mathematical functions, and more specifically to ascending or descending mathematical functions or combinations thereof, and even more specifically, but without limitation thereto, to electronic circuits for generating an output current that is a function of an input voltage, such as an exponential function, using one set of weights, a square function, using another set of weights, or a cubic function, using yet another set of weights.

2. Prior Art

The need for computation of functions such as exponential and trigonometric functions is well-known and documented in the art. There are a multitude of ways to generate the results of such functions for a variety of purposes, all of which are targeted toward a circuit level implementation. Each solution has certain advantages and certain deficiencies that may render a solution not suitable for a specific application. Generally the circuit level implementation can be described as belonging to one of two groups of implementations: digital, i.e., receiving a result through a numerical computation of one sort or another, and analog, i.e., having a circuit generate an output value that is proportionate to an input value in a way that implements the desired mathematical function.

Among the known digital types of solutions are the table lookup methods, polynomial approximation methods, digit-by-digit methods, and rational approximation. An analog circuit is disclosed in U.S. Pat. No. 6,771,111 by Sheng et al. That circuit attempts to use a single stage differential amplifier set-up to provide exponential function circuitry. However, the methods and circuits disclosed by prior art solutions are deficient in at least chip area, speed, or accuracy.

In view of the deficiencies of prior art solutions and in view of the need to provide fast and accurate mathematical functions, for example in wireless communication, it would be advantageous to provide circuits that are capable of providing mathematical functions. It would be further advantageous if such circuits were able to implement several mathematical functions without the need to use different circuit techniques or designs, i.e., be generally dependent on parameters of the circuit, not the circuit itself. It would be further beneficial if the output result was independent of process and temperature variations.

DETAILED DESCRIPTION OF THE PREFERRED EMBODIMENTS

Figure 1:
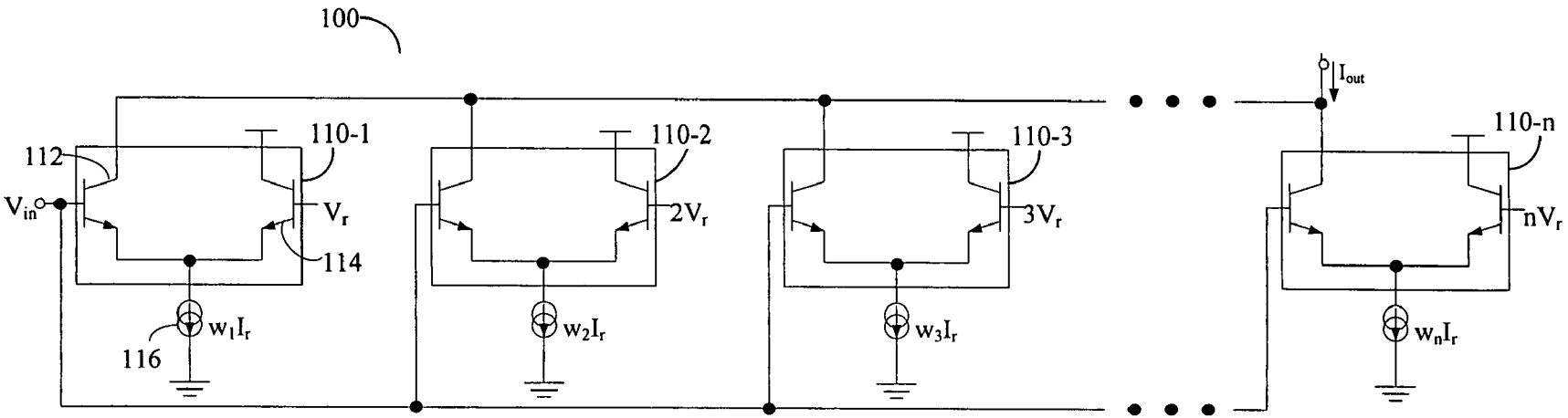
FIG. 1 is an exemplary circuit for implementation of a mathematical function in accordance with the disclosed invention.

Reference is now made to FIG. 1 where an exemplary and non-limiting circuit 100, for implementing a mathematical function in accordance with the disclosed invention, is shown. Circuit 100 comprises n cells 110-1 through **110-*n*, each cell 110 comprising two transistors 112 and 114, the transistors being, for example, bipolar NPN transistors, and further having their respective emitters coupled to each other. Each cell 110 has two input ports. At one port, i.e., the base of transistor 112, the input voltage $V_{in}$ is applied. At the other port, i.e., the base of transistor 114, a reference voltage is supplied. Each cell 110 receives a linearly increasing reference voltage, such that cell 110-1 receives a reference voltage $V_r$, cell 110-2 receives a reference voltage of $2V_r$, cell 110-3 receives a reference voltage of $3V_r$, and so forth, until cell 110-*n* receives a reference voltage of $nV_r$ at the base of each respective transistor 114. The voltage $(n+1)V_r$ preferably defines the maximum input range for a minimum error of the output value, i.e., $V_{in}$ cannot exceed the value of $(n+1)V_r$. $V_r$ may be provided in various ways, such as by way of example, by a bandgap voltage reference. The collectors of transistors 114 are connected to the positive voltage supply while the collectors of transistors 112 are connected to the output node. The coupled emitters of transistors 112 and 114 are connected to a current source 116, configured to be able to supply a current which is an integer multiple of a weighting factor, i.e., $I_r$ is a constant current and $w_i$, i=1, 2 . . . n are the weights by which the current $I_r$ varies. By using different weighting factors $w_i$, it is possible to cause circuit 100** to generate different mathematical functions as demonstrated in more detail below.

In one embodiment of the disclosed invention, circuit 100 is used for exponential function generation. In such a case, the weights of current sources 116 are $w_1=1$, for k=1, while $w_2=2$, $w_3=4$ . . . , $w_k=2^{k-1}$, . . . $w_n=2^{n-1}$ for k>1. When the input voltage $V_{in}$ satisfies $kV_r<V_{in}<(k+1)V_r$, then $V_{in}>V_r$, $V_{in}>2V_r$, . . . $V_{in}>kV_r$, $V_{in}<(k+1)V_r$, . . . , $V_{in}<nV_r$. Therefore, the cells 110-1, 110-2, . . . , **110-*k* are active (directing respective currents to the output $I_{out}$) while cells 110-(k+1), . . . , 110-*n* are disabled (directing respective currents to the supply). Assuming that when a cell 110-*k* is active, then the collector current of transistor 112-*k* is equal to $w_kI_r$, contributing to the output current, e.g., when $V_{in}$ is between $3V_r$ and $4V_r$, it means that k=3, therefore cells 110-1, 110-2, 110-3** are active and the output current gets the value $I_{out}=8I_r$. The output current $I_{out}$ is therefore given by the relation:

$$I_{out}(k) = I_r \sum_{i=1}^{k} w_i \qquad \text{Eq. (1)}$$

Using inductive reasoning, it can be proved that:

$$\sum_{i=1}^{k} w_i = 2^k \qquad \text{Eq. (2)}$$

The proof of equation (2) deviates from the scope of this document.

Thus, based on equation (1) and (2), we take:

$$I_{out}(k)=I_r 10^{k \log 2} \qquad \text{Eq. (3)}$$

Figure 2:
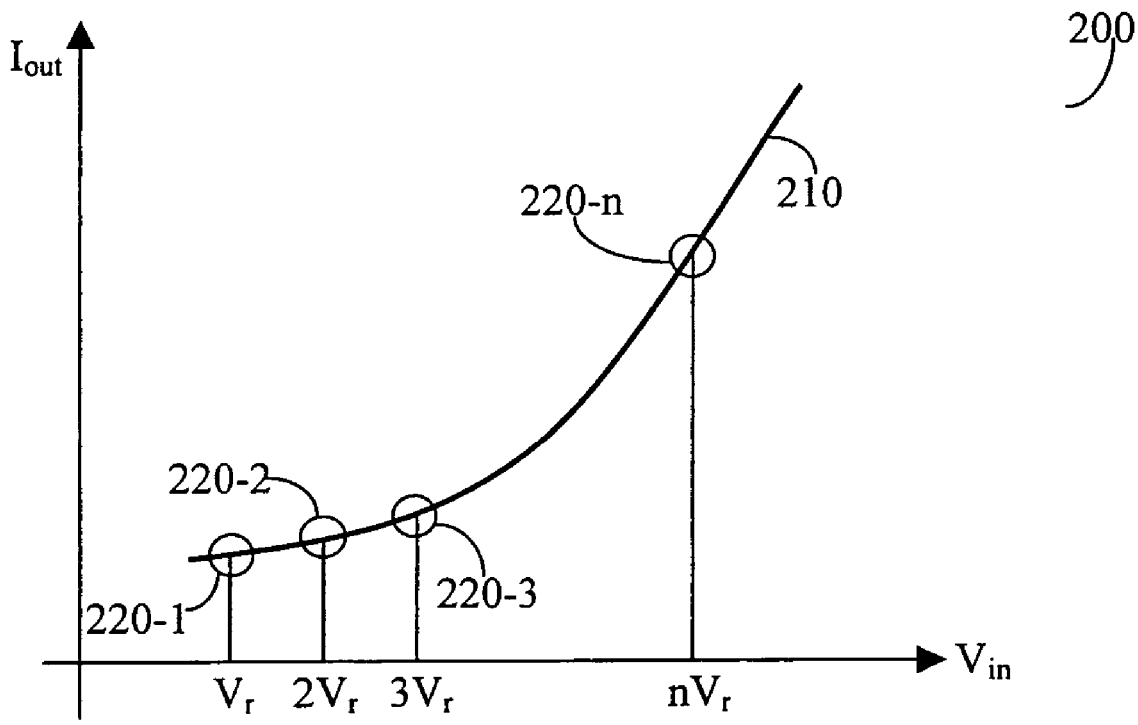
FIG. 2 is an exemplary graph of the output current as a function of the input voltage from a circuit designed in accordance with the disclosed invention.

This may be further understood when referring to FIG. 2 where an exemplary and non-limiting graph of the output current from circuit 100, as a function of the input voltage to circuit 100, is shown. Precise values of the exponential function are achieved at points 220-1, 220-2, 220-3, and so forth until point 220-*n*. When substituting k by $V_{in}/V_r$ in equation (2) then output current from circuit 100 is:

$$I_{out}(V_{in}) = I_r 10^{\frac{Vin}{(Vr)\log 2)}} \quad \text{Eq. (4)}$$

This equation is exact at integer values of $V_{in}/(kV_r)$, and approximate at other values. Equation (4) shows that $I_{out}$ is an exponential function of the input voltage $V_{in}$.

Thus the exponential function is generated using circuit 100. It should be noted that equation (4) is valid only at the discrete points $V_{in}=V_r$, $2V_r$ . . . $nV_r$. When $V_{in}$ is a value between the reference voltages, for example between $2V_r$ and $3V_r$, then the above relation is only approximately valid. Therefore between points $[V_r, 2V_r]$, $[2V_r, 3V_r]$, . . . , $[(n-1)V_r, nV_r]$ there may be an error that can be made very small and is dependent on the choice of $V_r$. The optimum value for $V_r$ in order to achieve a minimum error for bipolar transistors is approximately 75 mV. This value of the voltage reference has been chosen empirically. Ir has a typical value of approximately 1 μA, though $I_r$ will depend on the number of the cells used and the maximum value of the output current. Notably the output current at any point 220 (FIG. 2) of the exponential function of circuit 100 is substantially independent of process and temperature, as is shown in equation (4), since both $V_r$ and $I_r$ are constant. The variation of the error due to process and temperature is actually very small, especially when the optimal value for $V_r$ is used. More specifically, the relevant error of the output current is about ±1% for an input range from 1.2V to 1.7V. An exemplary circuit 100 may be designed using ten cells 110, with a 2.7V voltage supply, in a five metal 0.5 μm SiGe BiCMOS process. In this exemplary case, the worst case relevant error for ±3σ process variation and for a temperature range from −20° C. to 100° C. becomes ±2%. The circuit implementing the exponential function may be used, for example but is not limited to, a linear in dB gain control circuit of a variable gain amplifier (VGA) of a wireless transceiver integrated circuit. In some applications, but not necessarily all applications, the current sources are programmable so that the output as a function of the input may be changed, or at least initially programmed to provide the specific function desired.

In another embodiment of the disclosed invention, circuit 100 is used for the implementation of a squaring function. While circuit 100 remains the same, the weights of current sources 116 are set to $w_1=2$, $w_2=4$, . . . , $w_i=2i$, . . . , $w_n=2n$. When input voltage $V_{in}$ satisfies $V_{in}=kV_r$ then $V_{in}>V_r$, $V_{in}>2V_r$, . . . , $V_{in}=kV_r$, $V_{in}<(k+1)V_r$, . . . , $V_{in}<nV_r$. Therefore, the cells 110-1, 110-2, . . . , 110-(k−1) are active while cells 110-(k+1), . . . , 110-*n* are disabled. In the cell 110-*k* the collector current of transistor 112-*k* is equal to $(w_k/2)\ I_r$, contributing to the output current, e.g., when $V_{in}$, is $V_{in}=3V_r$ it means that k=3, therefore cells 110-1, 110-2 are active (directing current to the output $I_{out}$) while the cell 110-3 contributes with a current $(w_3/2)\ I_r$ to the output current. In that case the output current gets the value $I_{out}=9I_r$. The output current is therefore given by the relation:

$$I_{out}(k) = I_r\left[\sum_{i=1}^{k-1} w_i + \frac{w_k}{2}\right] \quad \text{Eq. (5)}$$

where it is assumed that in the case of k=1, $$\sum_{i=1}^{k-1} w_i = 0.$$

Equation (5) can be transformed to equation (6) as explained in more detail below:

$$I_{out}(k)=I_r k^2 \quad \text{Eq. (6)}$$

where k is defined by the maximum reference voltage $kV_r$ that the maximum input voltage $V_{in}$ may equal.

The transformation of equation (5) to equation (6) is based on the well-known formula:

$$\sum_{i=1}^{k} i = \frac{k(k+1)}{2} \quad \text{Eq. (7)}$$

Solving equation (7) for $k^2$ it is concluded that:

$$k^2 = \sum_{i=1}^{k-1} 2i + k \quad \text{Eq. (8)}$$

where it is assumed that in the case of $$k = 1, \sum_{i=1}^{k-1} 2i = 0.$$

As is mentioned above, the weights of current sources 116 are set to $w_i=2i$. Thus equation (8) yields:

$$k^2 = \left[\sum_{i=1}^{k-1} w_i + \frac{w_k}{2}\right] \quad \text{Eq. (9)}$$

Substituting k by $V_{in}/V_r$ in equation (6), the output current of circuit 100 is:

$$I_{out}(V_{in}) = \frac{I_r}{V_r^2} V_{in}^2 \quad \text{Eq. (10)}$$

resulting in a squaring function of $V_{in}$, since both $I_r$ and $V_r$ are constants. The optimum value for $V_r$, in order to achieve the minimum error, for bipolar transistors is 75 mV. This value of the voltage reference has been chosen empirically. $I_r$ has a typical value of approximately 10 μA, while the specific value of $I_r$ used will depend on the number of cells used and the maximum value of the output current. Notably, the output current at any point 220, of squaring function of circuit 200, is independent of process and temperature, as is shown in equation (10), since both $V_r$ and $I_r$ are constant. The actual variation of the error due to process and temperature is very small, especially when the optimal value for $V_r$ is used. More specifically, the relevant error of the output current is about ±0.4% for an input range from 1.1V to 1.7V. An exemplary circuit 100 may be designed with ten cells 110 with 2.7V voltage supply, in a five metal 0.5 μm SiGe BiCMOS process. The worst-case relevant error for a +3σ process variation and for a temperature range from −20° C. to 100° C. becomes ±0.6%. The circuit implementing the squaring function may be used, for example, as a power detector of a wireless transceiver integrated circuit.

In another embodiment of the disclosed invention, circuit 100 is used for the implementation of a cubic function. While circuit 100 remains the same, the weights of current sources 116 are set to $w_1=2$, $w_2=12$, $w_3=26$, . . . , $w_n=w_{n-1}+w_{n-2}-w_{n-3}+12$. The output current is therefore given by the relation:

$$I_{out}(k) = I_r\left[\sum_{i=1}^{k-1} w_i + \frac{w_k}{2}\right] \quad \text{Eq. (11)}$$

where k is defined by the maximum reference voltage $kV_r$ that the maximum input voltage $V_{in}$ may equal. The above equation is transformed to:

$$I_{out}(k)=I_rk^3 \quad \text{Eq. (12)}$$

A person skilled-in-the-art would be able to perform the transformation of equation (11) to equation (12) and hence such is not provided herein. Substituting $k=V_{in}/V_r$ in equation (12) the output current of circuit 100 is:

$$I_{out}(V_{in}) = \frac{I_r}{V_r^3} V_{in}^3 \quad \text{Eq. (13)}$$

resulting in a cubic function of $V_{in}$, since both $I_r$ and $V_r$ are constants. The optimum value for $V_r$, in order to achieve the minimum error, is 75 mV. $I_r$ has a typical value of 1 μA, while the specific value of $I_r$ used would depend on the desirable number of cells and the maximum value of the output current. Notably, the output current at any point 220, of cubic function of circuit 200, is independent of process and temperature as is shown in equation (13) since both $V_r$ and $I_r$ are constant. The variation of the error due to process and temperature is very small, especially when the optimal value for $V_r$ is used. More specifically, the relevant error of the output current is about ±0.45% for an input range from 1.25V to 1.75V. An exemplary circuit 100 may be designed with ten cells 110, in a five metal 0.5 μm SiGe BiCMOS process for 2.7V voltage supply. The worst-case relevant error versus process and for a temperature range from −20° C. to 100° C. is ±2.5%.

Figure 3:
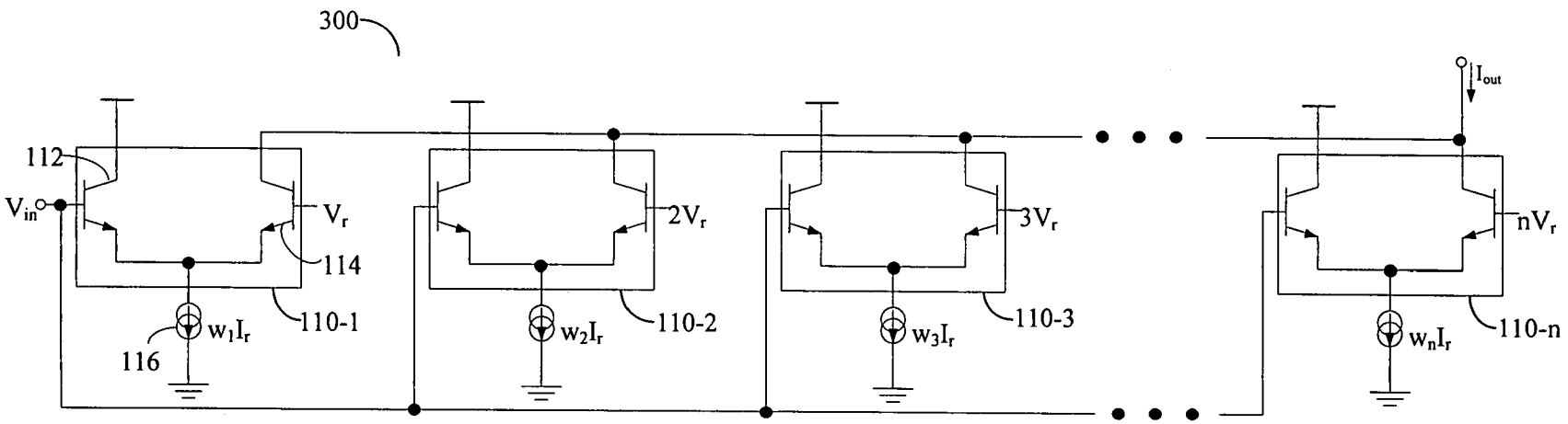
FIG. 3 is an exemplary circuit for implementation of an inverse mathematical function in accordance with the disclosed invention.

The implementation of the circuit as it was described above generates ascending functions. The circuit can be easily transformed in order to implement descending functions. Reference is made to FIG. 3 of circuit 300 where the collectors of transistors 112 are connected to the voltage supply and the collectors of transistors 114 are connected to the output node, then the circuit generates the descending functions. In this case, the output current is given by:

$$I_{\text{out_descending}}(k) = I_r\sum_{i=1}^{n} w_i - I_{out}(k) \quad \text{Eq. (14)}$$

where $I_{out}$ (k) is the current given by the equation (4) when the circuit generates exponential function, or by equation (10) when the circuit generates squaring function, or finally by equation (13) when the circuit generates cubic function. In each case $w_i$ are the weights that corresponds to the generating function.

While circuit inputs for an exponential function, a square function, and a cubic function, have been specifically disclosed herein, the circuits of the present invention may be used to generate other functions, easily mathematically expressible or not. By way of but one example, because of the speed of the circuits of the present invention, such circuits might be used to predistort a multi-channel RF input signal to a power amplifier, or to control the gain of the power amplifier with input signal amplitude, to linearize the output of the amplifier to prevent crosstalk between channels. Here, using bipolar transistors, one may still use $V_r$=75 mv, though pick (program) values of $w_i$ that generate the desired function such as by using Eq. (11), normally an increasing function of input signal amplitude, to offset the normal decrease in gain of an amplifier with input signal amplitude. One could even mix increasing and decreasing functions to obtain a function having a maximum or a minimum between the ends of the function by using a circuit, part of which is in accordance with FIG. 1 and part of which is in accordance with FIG. 3, if such a function were desired.

Also other transistor types and implementations are possible, including, but not limited to, metal-oxide semiconductor (MOS) transistors, without departing from the disclosures made herein. In the case of MOS transistors, one may use a different $V_r$, typically chosen to be sufficiently large so that when the input voltage $V_{in}$ equals a multiple of $V_r$, one half the respective current source is directed to the output, substantially all the prior current sources are directed to the output (FIG. 1) or a power supply terminal (FIG. 3) and substantially all the subsequent current sources are directed to the power supply terminal (FIG. 1) or to the output (FIG. 3) to minimize the number of cells required, but sufficiently small to provide a smooth transition from cell to cell as the input voltage changes. In one embodiment of the disclosed invention, circuit 100 is part of an integrated circuit (IC), preferably manufactured as a monolithic semiconductor device.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A circuit to output a mathematical function of an input to the circuit, the circuit comprising a plurality of core cells, each core cell having:

first and second transistors, each having first and second terminals and a control terminal, the conduction between the first and second terminals being controlled by the voltage between the control terminal and the first terminal;

the first and second transistors of each core cell having their first terminals coupled together and through a respective weighted current source to a first power supply terminal;

the first transistor of each core cell having its second terminal coupled to the output and the second transistor of each core cell having its second terminal coupled to a second power supply terminal;

the control terminal of one of the first and second transistors of each core cell being coupled to the input and the control terminal of the other of the first and second transistors of each core cell being coupled to a respective reference voltage;

the respective reference voltage supplied to each of the plurality of core cells being a monotonically increasing integer value times the reference voltage supplied to the first core cell.

2. The circuit of claim 1 wherein the control terminals of all of the first transistors are coupled to the input.

3. The circuit of claim 1 wherein the control terminals of all of the second transistors are coupled to the input.

4. The circuit of claim 1 wherein the transistors are selected from the group consisting of bipolar and metal-oxide semiconductor transistors.

5. The circuit of claim 1 wherein the weighted current sources are weighted to provide one of an exponential function, a squaring function and a cubic function.

6. The circuit of claim 5 wherein for the exponential function, the weighted source current of the $n^{th}$ core cell provides a current which is $2^n$ times a predetermined reference current.

7. The circuit of claim 5 wherein for the squaring function, the current source of the $n^{th}$ core cell provides a current which is 2n times a predetermined reference current.

8. The circuit of claim 5 wherein for the cubic function, the weighted current source of the $n^{th}$ core cell provides a current which is $w_n$ multiplied by the predetermined reference current, wherein $w_1=2$, $w_2=12$ and $w_3=26$, and for n>3, $w_n$ equals $w_{(n-1)}$ plus $w_{(n-2)}$ minus $w_{(n-3)}$ plus twelve.

9. The circuit of claim 1 wherein the transistors are bipolar transistors and the reference voltage supplied to the first core cell is 75 mV.

10. The circuit of claim 1 comprising an integrated circuit.

11. A circuit configured to output an exponential function of an input to the circuit, the circuit comprising a plurality of core cells, each core cell having:

first and second transistors, each having first and second terminals and a control terminal, the conduction between the first and second terminals being controlled by the voltage between the control terminal and the first terminal;

the first and second transistors of each core cell having their first terminals coupled together and through a respective weighted current source to a power supply terminal, the weighted current source of the $n^{th}$ core cell being configured to supply a current of $2^n$ times a predetermined reference current;

the first transistor of each core cell having its control terminal coupled to the input and its second terminal coupled to the output;

the second terminal of the second transistor of each core cell being coupled to a power supply terminal and the control terminal of the second transistor of each of the core cells being coupled to a respective reference voltage equal to a monotonically increasing integer value times the reference voltage supplied to the first core cell.

12. The circuit of claim 11 wherein the transistors are selected from the group consisting of bipolar and metal-oxide semiconductor transistors.

13. The circuit of claim 11 wherein the transistors are bipolar transistors and the reference voltage supplied to the first core cell is 75 mV.

14. The circuit of claim 11 comprising an integrated circuit.

15. A circuit configured to output a squaring function of an input to the circuit, the circuit comprising a plurality of core cells, each core cell having:

first and second transistors, each having first and second terminals and a control terminal, the conduction between the first and second terminals being controlled by the voltage between the control terminal and the first terminal;

the first and second transistors of each core cell having their first terminals coupled together and through a respective weighted current source to a power supply terminal, the weighted current source of the $n^{th}$ core cell being configured to supply a current of 2n times a predetermined reference current;

the first transistor of each core cell having its control terminal coupled to the input and its second terminal coupled to the output;

the second terminal of the second transistor of each core cell being coupled to a power supply terminal and the control terminal of the second transistor of each of the core cells being coupled to a respective reference voltage equal to a monotonically increasing integer value times the reference voltage supplied to the first core cell.

16. The circuit of claim 15 wherein the transistors are selected from the group consisting of bipolar and metal-oxide semiconductor transistors.

17. The circuit of claim 15 wherein the transistors are bipolar transistors and the reference voltage supplied to the first core cell is 75 mV.

18. The circuit of claim 15 comprising an integrated circuit.

19. A circuit configured to output a cubic function of an input to the circuit, the circuit comprising a plurality of core cells, each core cell having:

first and second transistors, each having first and second terminals and a control terminal, the conduction between the first and second terminals being controlled by the voltage between the control terminal and the first terminal;

the first and second transistors of each core cell having their first terminals coupled together and through a respective weighted current source to a power supply terminal, the weighted current source of the $n^{th}$ core cell providing a current which is $w_n$ multiplied by the predetermined reference current, wherein $w_1=2$, $w_2=12$ and $w_3=26$, and for n>3, $w_n$ equals $w_{(n-1)}$ plus $w_{(n-2)}$ minus $w_{(n-3)}$ plus twelve;

the first transistor of each core cell having its control terminal coupled to the input and its second terminal coupled to the output;

the second terminal of the second transistor of each core cell being coupled to a power supply terminal and the control terminal of the second transistor of each of the core cells being coupled to a respective reference voltage equal to a monotonically increasing integer value times the reference voltage supplied to the first core cell.

20. The circuit of claim 19 wherein the transistors are selected from the group consisting of bipolar and metal-oxide semiconductor transistors.

21. The circuit of claim 19 wherein the transistors are bipolar transistors and the reference voltage supplied to the first core cell is 75 mV.

22. The circuit of claim 19 comprising an integrated circuit.

23. A method of generating a mathematical function comprising:

providing first and second transistors, each having first and second terminals and a control terminal, the conduction between the first and second terminals being controlled by the voltage between the control terminal and the first terminal;

coupling the first terminals the first and second transistors of each core cell together and through a respective weighted current source to a first power supply terminal;

coupling the second terminal of the first transistor of each core cell to an output and the second terminal of the second transistor of each of the core cells to a second power supply terminal;

coupling the control terminal of one of the first and second transistors of each core cell to an input and the control terminal of the other of the first and second transistors to a respective reference voltage, the reference voltage supplied to respective core cells being a monotonically increasing integer value times the reference voltage supplied to the first core cell;

receiving an input signal on the input;

providing an output current on the output as a sum of currents of a number of core cells responsive to the input.

24. The method of claim 23 to create an output that is an ascending function of the input comprising coupling the control terminals of all of the first transistors to the input.

25. The method of claim 23 to create an output that is an descending function of the input comprising coupling the control terminals of all of the second transistors to the input.

26. The method of claim 23 wherein the weighted current sources are weighted to provide one of an exponential function, a squaring function and a cubic function.

27. The method of claim 26 wherein for the exponential function, the weighted source current of the $n^{th}$ core cell is caused to provide a current which is $2^n$ of a predetermined reference current.

28. The method of claim 26 wherein for the squaring function, the current source of the $n^{th}$ core cell is caused to provide a current which is 2n of a predetermined reference current.

29. The method of claim 26 wherein for the cubic function, the weighted current source of the $n^{th}$ core cell is caused to provide a current which is $w_n$ multiplied by the predetermined reference current, wherein $w_1=2$, $w_2=12$ and $w_3=26$, and for $n>3$, $w_n$ equals $w_{(n-1)}$ plus $w_{(n-2)}$ minus $w_{(n-3)}$ plus twelve.

30. The method of claim 26 wherein the reference voltage supplied to the first core cell is 75 mV.

31. The method of claim 26 executed in an integrated circuit.

* * * * *